US010427287B2

(12) United States Patent
Wright

(10) Patent No.: US 10,427,287 B2
(45) Date of Patent: Oct. 1, 2019

(54) TOOL FOR ENHANCING TORQUE APPLICATION TO ROTATING TOOLS

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 529 days.

(21) Appl. No.: 15/141,574

(22) Filed: Apr. 28, 2016

(65) Prior Publication Data

US 2016/0318172 A1 Nov. 3, 2016

Related U.S. Application Data

(60) Provisional application No. 62/153,981, filed on Apr. 28, 2015.

(51) Int. Cl.
*B25G 1/04* (2006.01)
*B25G 3/24* (2006.01)

(52) U.S. Cl.
CPC ..... *B25G 1/043* (2013.01); *B25G 3/24* (2013.01)

(58) Field of Classification Search
None
See application file for complete search history.

(56) References Cited

U.S. PATENT DOCUMENTS

| | | | | | |
|---|---|---|---|---|---|
| 791,298 | A | | 5/1905 | Smith et al. | |
| 1,016,607 | A | | 2/1912 | Booman | |
| 1,417,338 | A | | 5/1922 | Lenahan | |
| 2,331,743 | A | * | 10/1943 | Sullivan | B65H 75/243 242/571.2 |
| 2,520,652 | A | | 8/1950 | Pfauser et al. | |
| 2,652,736 | A | | 9/1953 | Keine | |
| 3,175,436 | A | | 3/1965 | Coleman | |
| 3,361,170 | A | | 1/1968 | Hilton | |
| 3,404,427 | A | * | 10/1968 | Mack | B62B 1/20 16/427 |
| 3,963,235 | A | * | 6/1976 | Snellman | B65H 29/16 198/602 |
| 4,703,677 | A | | 11/1987 | Rossini | |
| 4,754,670 | A | | 7/1988 | Raymond | |
| 4,958,407 | A | | 9/1990 | Johnson | |
| 5,303,439 | A | | 4/1994 | Seals | |
| 5,400,681 | A | | 3/1995 | Strauch | |
| 5,480,166 | A | * | 1/1996 | Milsop | B25B 23/00 279/143 |
| 5,522,287 | A | | 6/1996 | Chiang | |
| 5,570,617 | A | | 11/1996 | Love | |
| 6,257,102 | B1 | | 7/2001 | Perry | |
| 8,220,852 | B2 | | 7/2012 | Fenstemaker | |
| 8,746,767 | B2 | | 6/2014 | Mouch et al. | |
| 9,194,407 | B1 | * | 11/2015 | Straney | F16B 2/06 |
| 9,289,895 | B1 | * | 3/2016 | Bauer | B25G 3/20 |
| 2003/0163897 | A1 | * | 9/2003 | Spinelli | B25G 1/04 16/110.1 |

* cited by examiner

*Primary Examiner* — Brian D Keller

(57) ABSTRACT

An extension bar apparatus and methods are usable for enhancing or applying increased torque to mechanical tools, such as wrenches and ratchets, to reduce or minimize the force applied by a user to the mechanical tool for producing work. The extension bar apparatus comprises a metallic tube with a hollow on one end for receiving a mechanical tool handle, which then engages with a plurality of bracing dogs that are each perpendicular to the other and affixed to the mechanical tool through multiple threaded members, some of which extend through the inner surface to the outer surface, and wherein the application of a rotational force to the extension bar apparatus applies torque to the mechanical tool.

14 Claims, 5 Drawing Sheets

TOOL FOR ENHANCING TORQUE APPLICATION TO ROTATING TOOLS

PRIORITY

This application claims the benefit of and priority to U.S. Provisional Application No. 62/153,981, filed Apr. 28, 2015, by David C. Wright, entitled "Tool for Enhancing Torque Application to Rotating Tools." The disclosure of this provisional application is herein incorporated by reference.

FIELD

The present application relates generally to an apparatus and methods for enhancing or applying increased torque to mechanical tools, which serves to reduce or minimize the applied force required by the user.

BACKGROUND

"Cheater bars" are well-known in the field of mechanical engineering as devices which clamp onto the handle of a tool, such as a wrench or ratchet, and increase the effective radius of the rotation of the tool, thereby allowing the proportional application of more torque force to the rotation of the tool head. The simplest, improvised cheater bars are often simply pieces of pipe scrapped from elsewhere.

However, these cheater bars often come with disadvantages. Most pertinently, the connection between the cheater bar and the tool handle must be strong enough to withstand the force necessary to generate the torque at the head of the tool, or else the cheater bar may come loose and be propelled into the apparatus being torqued, possibly with the user in tow, resulting in damage and injury.

Prior art cheater bars, such as those described in U.S. Pat. No. 5,570,617, or U.S. Pat. No. 6,257,102, have attempted to overcome this weakness by utilizing various clamping mechanisms to secure the cheater bar to the base handle of the tool. However, these clamping mechanisms ultimately rely on an attachment force that is normal to the direction of the torque, rather than directly bracing the tool against the direction in which the tool is being rotated. Embodiments of the apparatus described herein represent a significant improvement to these concepts.

A need exists for an apparatus that can be used to enhance or apply increased torque to mechanical tools, such as wrenches or ratchets, and thereby minimize or reduce the amount of force, including a rotational force or partially rotational force, which is required by the user to produce work.

A need exists for methods of using an apparatus to enhance or apply increased torque to mechanical tools, such as wrenches or ratchets, minimizing or reducing the amount of force, including a rotational force or partially rotational force, that is required by the user to produce work.

Embodiments of the present disclosure, described herein, meet these needs.

BRIEF DESCRIPTION OF THE DRAWINGS

In the detailed description of the embodiments, presented below, reference is made to the accompanying drawings.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

The present disclosure relates generally to an apparatus and methods for enhancing or applying increased torque to mechanical tools, such as wrenches or ratchets, which serves to reduce or minimize the applied force required by the user for producing work.

Figure 1:
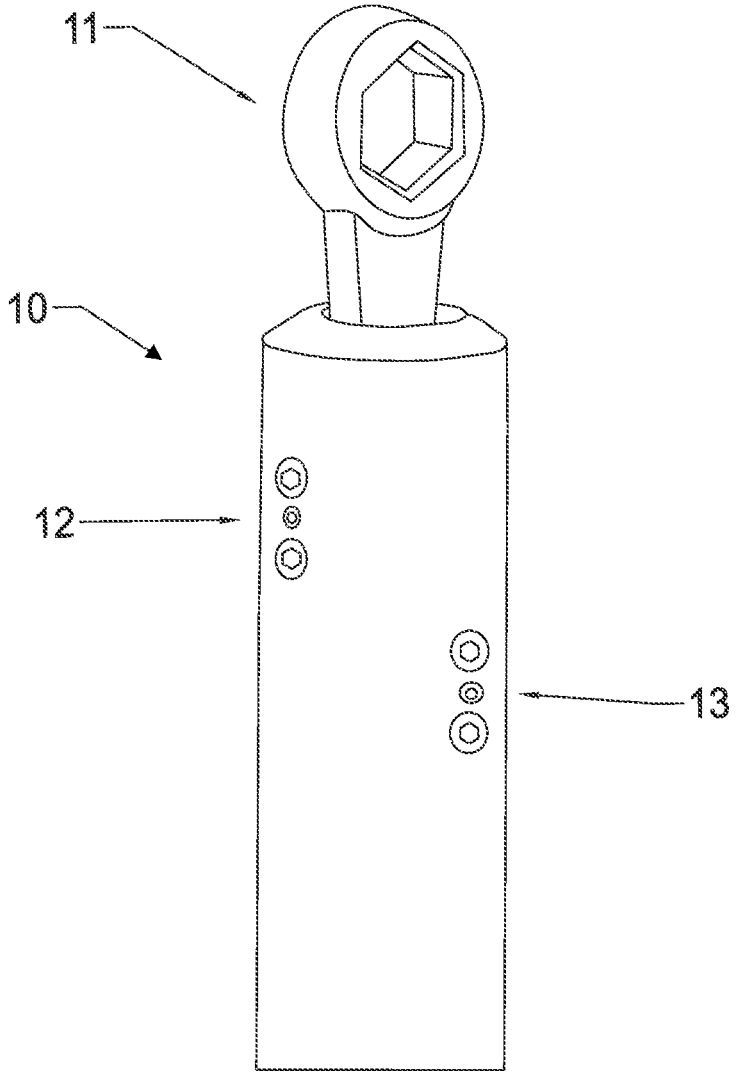
FIG. 1 depicts an external view of an embodiment of the claimed tool.

Referring to FIG. 1, the apparatus comprises a tool extender 10 that is fitted around a hand tool 11, depicted as an enclosed ratchet in this embodiment. It is to be understood that the hand tool may be any hand tool, including a wrench or any other rotational tool which has a handle. The tool extender 10 can be attached to the hand tool 11 via a plurality of bracing members 12, 13, 14, 15 (14 and 15 not visible in FIG. 1), which will be described in more detail.

Figure 2:
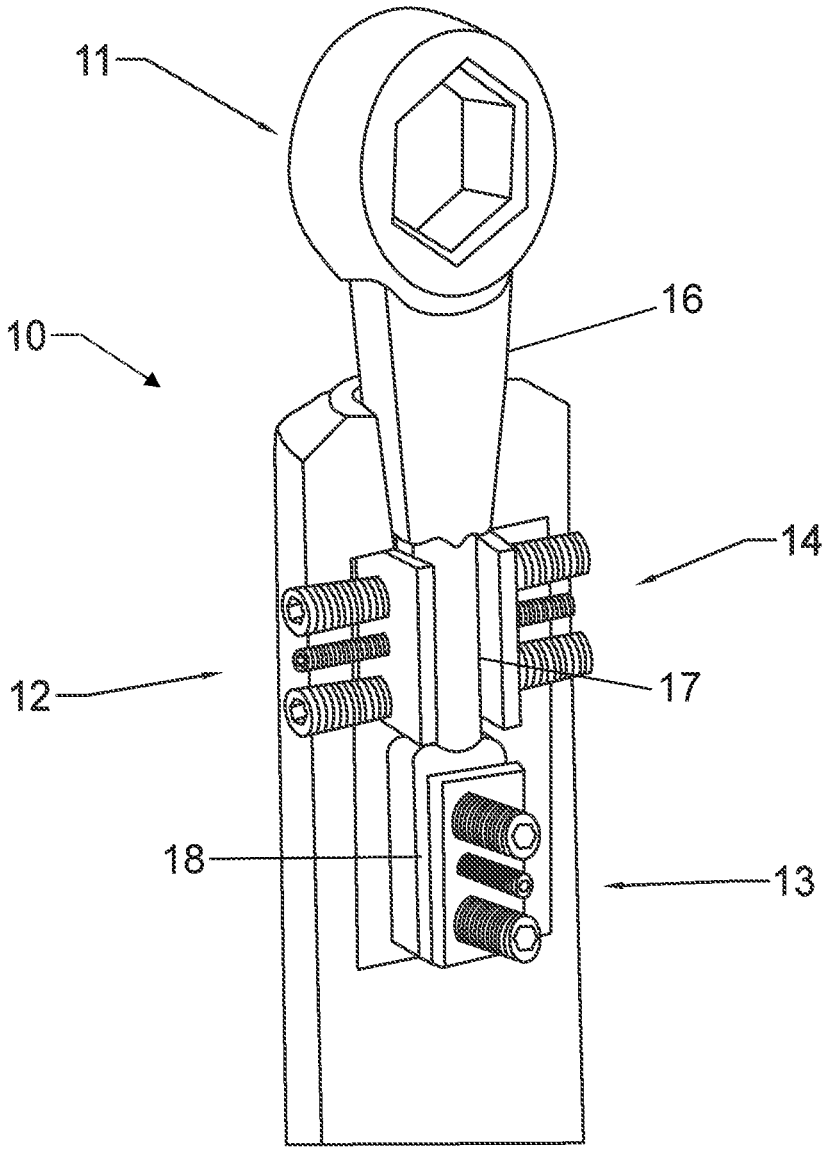
FIG. 2 depicts a cutaway view of an embodiment of the claimed tool.

FIG. 2 depicts a cutaway view of the tool extender 10 comprising a tube having a hollow at one end depicted in FIG. 1, showing the structure of bracing members 12, 13, 14, and 15 (15 not visible in FIG. 2). As shown, bracing members 12 and 14 are located on opposite sides of the hand tool 11, as are bracing members 13 and 15. The relative positions of the bracing members around the tool extender 10 can allow the hand tool 11 to be directly braced from at least one direction that is opposed to the direction of the torquing. In this embodiment, the hand tool 11 is depicted having a handle 16 with bracing surfaces 17, 18 aligned against a respective pair of bracing members 12, 14 and 13, 15 although in other embodiments the hand tool 11 may constitute a single bracing surface along the length of handle 16, or none at all.

Figure 3:
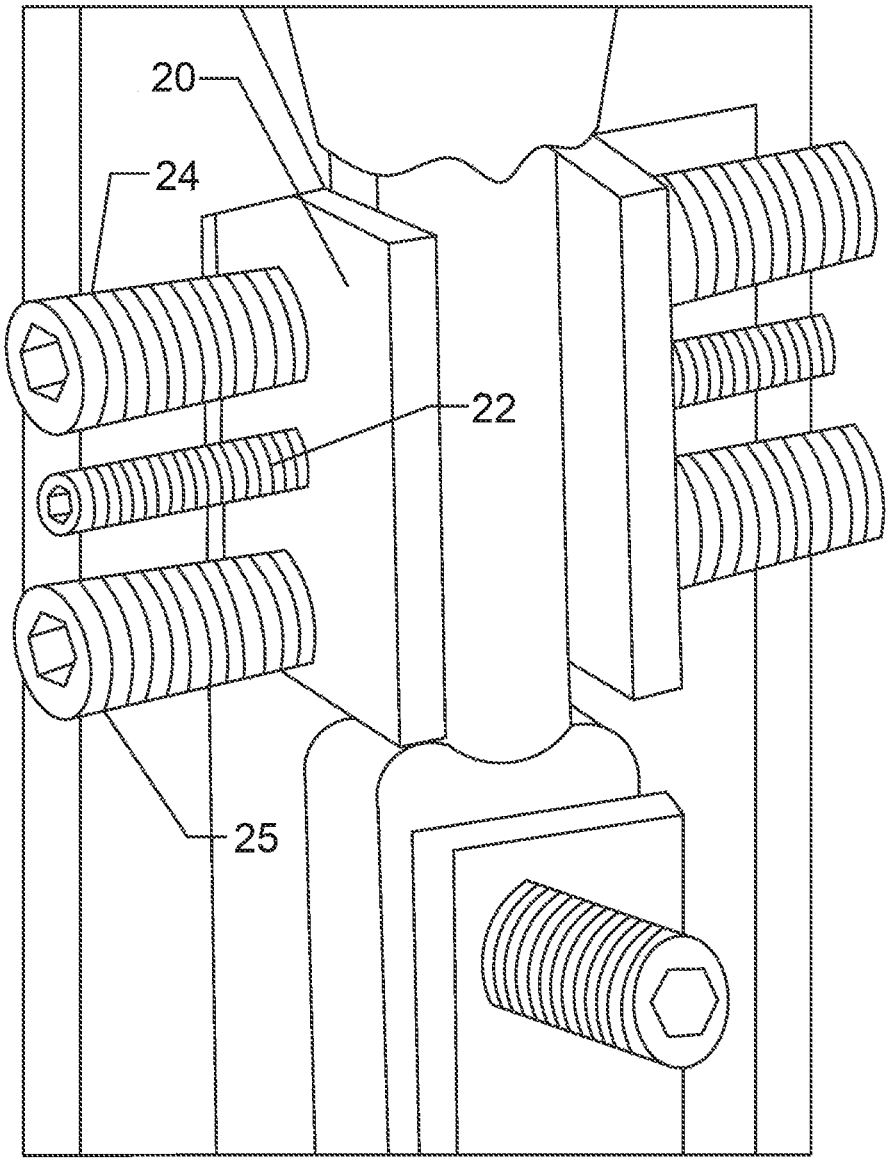
FIG. 3 depicts a detail view of an embodiment of the claimed tool.

FIG. 3 depicts a close-up view of the bracing members 12, 14 as depicted in FIG. 2. Each bracing member 12, 13, 14, 15 can comprise a dog 20 (also known as a bracing dog), at least one center thread 22 (also known as a center threaded member), and at least two lateral threads 24, 25 (also known as outer threaded members). As depicted, the center threads and lateral threads have "ratchet-dog" heads for mating with an Allen wrench or similar hex tool for loosening and tightening; however, it can be appreciated that other loosening and tightening methods could be used without departing from the scope of this disclosure.

Each bracing member can comprise a center thread 22 that can vary in size, including a width and/or a length of the threads, in comparison to the size of each of the lateral threads 24, 25. In an embodiment, the center thread 22 can comprise a length that is shorter and/or a width that is smaller than the length and/or width of the lateral threads. As depicted in FIG. 3, the embodiment of the bracing member comprises a center thread 22 that includes a shorter thread length and a smaller thread width than each of the two lateral threads 24, 25.

Figures 4A, 4B, 4C:
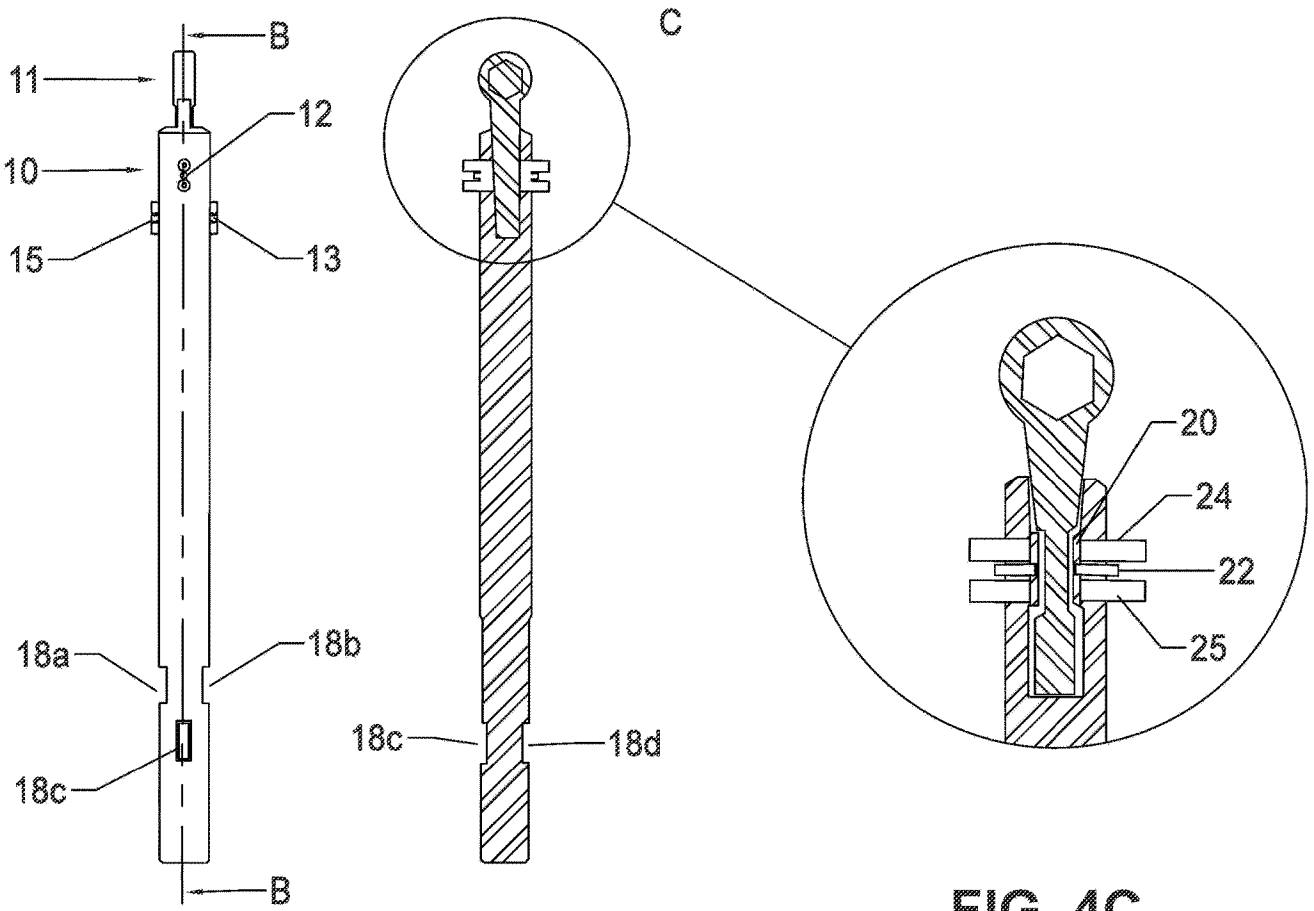
FIG. 4A depicts a schematic view of an embodiment of the claimed tool.
FIG. 4B depicts a view along line B-B in FIG. 4A.
FIG. 4C depicts a detail view of area C in FIG. 4B.

FIGS. 4A, 4B, and 4C depict a schematic view of an embodiment of the tool, with the angle of FIG. 4B indicated by the B-B line of FIGS. 4A, and 4C enlarging the area depicted by the C-region of FIG. 4B. Particularly, as indicated by the cutaway zoom of FIG. 4C, the center thread 22 of each bracing member extends at least partially through the dog 20, while the lateral threads 24, 25 end at the surface of the dog 20, in order to brace and fit the tool extender 10 against and/or around the hand tool 11. This allows the dogs 20 to be positioned within the hand tool 11 using the center thread 22, before being tightened with the lateral threads 24, 25, to accommodate a variety of tool sizes. In addition, the embodiments of FIGS. 4A and 4B depict notches 18*a*-18*d* located on the distal handle portion of tool extender 10. The depicted arrangement follows the same pattern as the handle 16 of the tool depicted in FIG. 1, aligning the handle of the tool extender 10 with bracing members 12, 13, 14, and 15 to allow the use of multiple tool extenders 10 (depicted as tapered in the FIGS. 4A and 4B embodiments), although it can be appreciated than any pattern of notches, including a circumferential notch, may be within the scope of this disclosure.

Figures 5A, 5B, 5C, 5D, 5E, 5F:
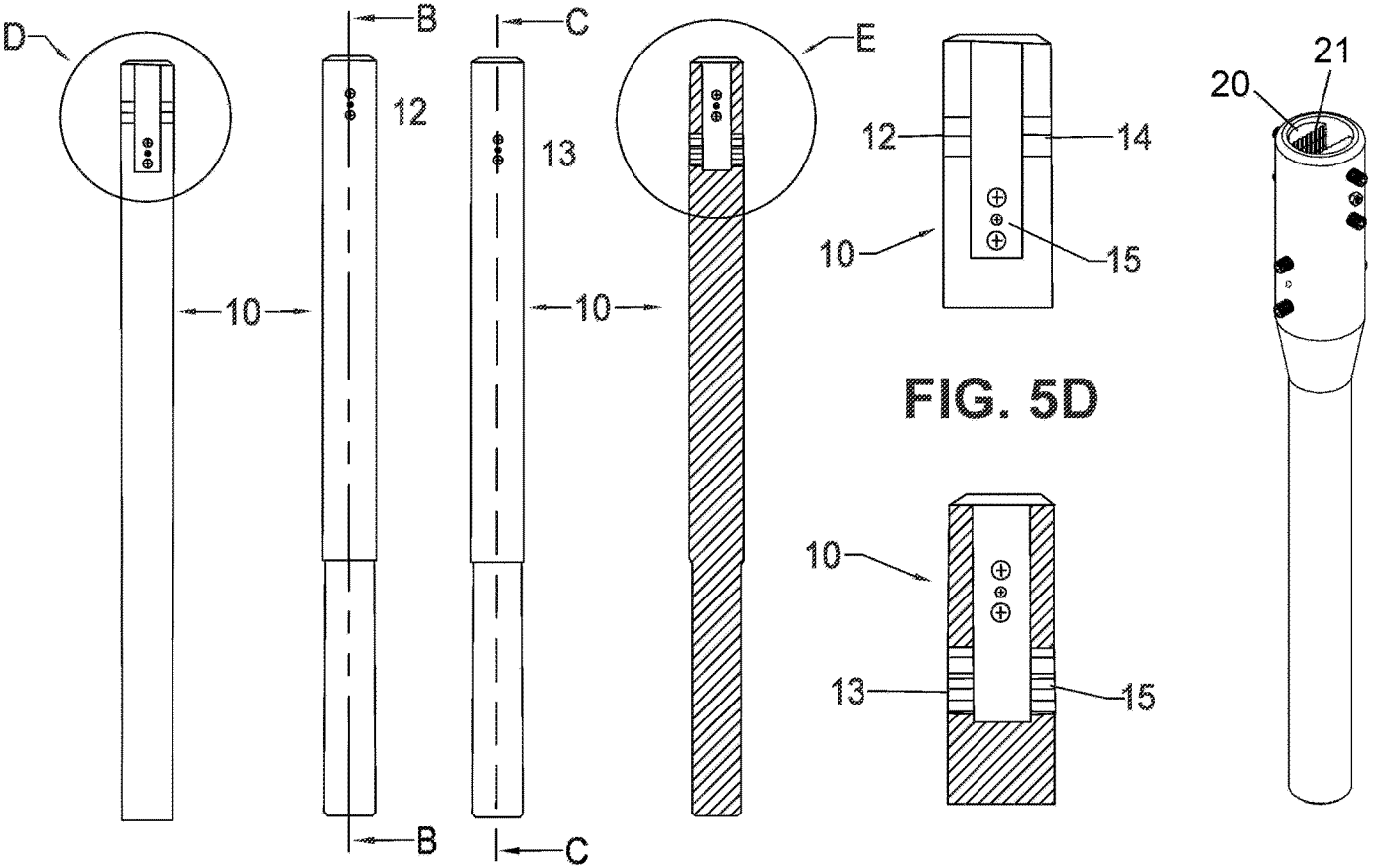
FIG. 5A depicts a side view and a front view of an embodiment of the claimed tool.
FIG. 5B depicts a view along line B-B in FIG. 5A.
FIG. 5C depicts a view along line C-C in FIG. 5A.
FIG. 5D depicts a detail view of area D in FIG. 5B.
FIG. 5E depicts a detail view of area E in FIG. 5E.
FIG. 5F depicts an isometric view of the embodiment depicted in FIGS. 5A-5E.

FIGS. 5A, 5B, 5C, 5D, 5E, and 5F illustrate the relative positioning of the bracing members on the tool extender 10, pictured without the hand tool 11. FIG. 5B is oriented along the B-B line of FIG. 5A, while FIG. 5C is cut-away along the C-C line. FIGS. 5D and 5E are enlargements of regions D and E, respectively, while FIG. 5F is an external isometric view. In this embodiment, bracing members 12, 14 constitute one paired set that is positioned opposite of one another and closer to the hand tool 11 than bracing members 13, 15, which constitute a second paired set that is positioned opposite of one another, and farther down the tool extender 10. The bracing members can be arranged in this way, as depicted in FIGS. 5D and 5E, to avoid the dogs 20 impacting on one another during the tightening of the tool extender 10 on especially small tools. While the depicted embodiment shows the bracing members 12, 13, 14, 15 positioned on the tool extender 10 at substantially right angles to one another, it can be appreciated that other arrangements of the bracing members may be made on and about the tool extender 10. FIG. 5F shows the inner surface 21 of dog 20 as toothed, for improved gripping of tools which may not have distinct mating surfaces.

FIGS. 5A-5F further depict the center thread 22 and the lateral threads 24, 25 of the extender tool 10 comprising grooves, which can be used for mating with screwdrivers, rather than Allen wrenches, as the embodiments shown in FIGS. 1-3.

While various embodiments usable within the scope of the present disclosure have been described with emphasis, it should be understood that within the scope of the appended claims, the present invention can be practiced other than as specifically described herein.

What is claimed is:

1. An extension bar for increasing a torque force of a tool, wherein the extension bar comprises:

a tube having an outer surface, a first end and a second end, wherein the first end comprises a hollow with an inner surface for receiving at least one portion of the tool, wherein the inner surface of the hollow comprises four bracing dogs, wherein the four bracing dogs are each affixed to the tool with a center threaded member and at least two outer threaded members, wherein the center threaded member of each respective bracing dog extends past an outer surface of the respective bracing dog, and wherein the at least two outer threaded members of each respective bracing dog terminate against the outer surface of the respective bracing dog, wherein the center threaded members and the outer threaded members each extend through the inner surface of the tube to the outer surface of the tube, wherein the four bracing dogs and their respective outer threaded members exert pressure on the tool.

2. The extension bar of claim 1, wherein the four bracing dogs comprise a first pair of bracing dogs along a first axis and a second pair of bracing dogs along a second axis, and wherein the first axis and second axis are perpendicular to each other.

3. The extension bar of claim 2, wherein the first pair of bracing dogs and the second pair of bracing dogs are longitudinally offset along the tube.

4. The extension bar of claim 1, wherein the four bracing dogs each comprise a toothed inner surface for increasing the friction on the tool.

5. The extension bar of claim 1, wherein the center threaded members and the outer threaded members each comprise a socket for receiving a hex tool.

6. The extension bar of claim 1, wherein the center threaded members and the outer threaded members each comprise a groove for receiving a screwdriver.

7. The extension bar of claim 1, further comprising a plurality of notches proximate to the second end of the tube.

8. A method for applying a torque force to a hand tool, wherein steps of the method comprise:

inserting a plurality of bracing dogs into a hollow in a proximal end of a first extension bar;

threaded members at least partially through a bracing surface of a respective bracing dog to secure the plurality of bracing dogs into a desired position;

inserting the hand tool into the proximal end of the first extension bar between the plurality of bracing dogs;

threaded members against the bracing surface of the respective bracing dog to tighten the plurality of bracing dogs against the hand tool; and rotating the extension bar to apply the torque force to the hand tool.

9. The method of claim 8, wherein the step of inserting the plurality of bracing dogs into the first extension bar comprises inserting a first plurality of bracing dogs along a first axis, and inserting a second plurality of bracing dogs along a second axis perpendicular to the first axis.

10. The method of claim 9, wherein the step of inserting the plurality of bracing dogs into the first extension bar comprises inserting the first plurality of bracing dogs in a first position along the extension bar, and inserting the second plurality of bracing dogs in a second position along the extension bar, wherein the first position and the second position are longitudinally offset.

11. The method of claim 8, wherein the step of threading each of the first plurality of threaded members, the step of threading each of the second plurality of threaded members, or combinations thereof, comprises rotating each of the respective threaded members utilizing a hex tool.

12. The method of claim 8, wherein the step of threading each of the first plurality of threaded members, the step of threading each of the second plurality of threaded members, or combinations thereof, comprises rotating each of the respective threaded members utilizing a screwdriver.

13. The method of claim 8, further comprising the steps of:

inserting a second plurality of bracing dogs into an additional extension bar;

threading each of a third plurality of threaded members to secure the second plurality of bracing dogs into a desired position;

inserting a distal end of the first extension bar into a proximal end of the additional extension bar between the second plurality of bracing dogs; and threading a fourth plurality of threaded members to tighten the second plurality of bracing dogs against the first extension bar.

14. The method of claim 13, wherein the step of inserting the second plurality of bracing dogs into the additional extension bar comprises aligning the second plurality of bracing dogs with a plurality of notches in the distal end of the first extension bar.

* * * * *